US007704110B2

(12) United States Patent
Wiatrowski et al.

(10) Patent No.: US 7,704,110 B2
(45) Date of Patent: Apr. 27, 2010

(54) ENGINE STARTING SYSTEM FOR A MARINE OUTBOARD ENGINE

(75) Inventors: Darrell Wiatrowski, Beach Park, IL (US); Gregry Remmers, Ingleside, IL (US)

(73) Assignee: BRP US Inc., Sturtevant, WI (US)

( * ) Notice: Subject to any disclaimer, the term of this patent is extended or adjusted under 35 U.S.C. 154(b) by 304 days.

(21) Appl. No.: 11/848,770

(22) Filed: Aug. 31, 2007

(65) Prior Publication Data

US 2009/0061705 A1 Mar. 5, 2009

(51) Int. Cl.
*B63H 21/21* (2006.01)

(52) U.S. Cl. ..... 440/85

(58) Field of Classification Search ..... 320/166, 320/167, 104, 116, 117, 126, 127; 123/179.1, 123/179.3; 440/85; 307/64–66, 10.6, 46, 307/48; 290/27, 28, 32, 47, 56
See application file for complete search history.

(56) References Cited

U.S. PATENT DOCUMENTS 5,704,819 A * 1/1998 Isogawa ..... 440/88 L
5,818,115 A 10/1998 Nagao
6,717,291 B2 4/2004 Purkey

* cited by examiner

*Primary Examiner*—Ed Swinehart
(74) *Attorney, Agent, or Firm*—Osler, Hoskin & Harcourt LLP

(57) ABSTRACT

A marine outboard engine for a watercraft is disclosed. The marine outboard engine includes a starter motor operatively connected to the crankshaft of the engine and a capacitor electrically connected to the starter motor. The capacitor is powering the starter motor to initiate rotation of the crankshaft. An alternator is operatively connected to the engine and is electrically connected to the capacitor for charging the capacitor when the engine is operating. A starting system and a method for operating a starting system of a marine outboard engine are also disclosed.

12 Claims, 9 Drawing Sheets

ENGINE STARTING SYSTEM FOR A MARINE OUTBOARD ENGINE

FIELD OF THE INVENTION

The present invention relates to an engine starting system. More specifically, the present invention relates to an engine starting system to be used in a marine outboard engine.

BACKGROUND OF THE INVENTION

Marine outboard engines for boats or watercraft are typically provided with either a pull-start system or a starter motor. The pull-start system initiates rotation of the crankshaft of the engine by pulling on a rope operatively connected to the crankshaft to start the engine. The starter motor is typically positioned inside the cowling of the marine outboard engine and is connected to one or more batteries separate from the engine and positioned inside the watercraft that provide the electric power to the starter motor to initiate rotation of the crankshaft to start the engine.

In small boats or watercraft, a battery sitting on the deck or inside the hull can be cumbersome and take valuable space. Furthermore, the typically heavy battery must often be loaded and unloaded from the smaller watercraft for maintenance or during transport of the watercraft adding to the inconvenience of the battery. However, a battery powered starter for marine outboard engines allows for an easy engine start.

Pull-start systems on the other hand are incorporated into the marine outboard engine and therefore take no additional space in the watercraft. However, pull-start systems require a certain level of upper body strength from the user in order to start the marine outboard engine as the rope must often be pulled while in the seated position, which some user may find difficult and strenuous to operate.

Thus, there is a need for a marine outboard engine having a starter system that alleviates at least some of the drawback of prior starter systems for marine outboard engine.

SUMMARY OF THE INVENTION

It is an object of the present invention to provide a marine outboard engine that alleviates at least some of the inconvenience in the prior art.

It is also an object of the present invention to provide a marine outboard engine having a battery-less starting system.

It is another object of the present invention to provide a marine outboard engine having a starting system powered by a capacitor.

One aspect of the present invention is to provide a marine outboard engine comprising: a cowling, an engine disposed in the cowling, the engine including a crankcase, at least one cylinder connected to the crankcase, and a crankshaft disposed in the crankcase. A driveshaft is disposed in the cowling generally parallel to the crankshaft, one end of the driveshaft is operatively connected to the crankshaft. A gear case assembly is connected to the cowling and a transmission is disposed in the gear case assembly. The transmission is operatively connected to the second end of the driveshaft and a propeller shaft disposed at least in part in the gear case assembly, generally perpendicular to the driveshaft, is operatively connected to the transmission. A bladed rotor is connected to the propeller shaft. A starter motor is operatively connected to the crankshaft of the engine and a capacitor is electrically connected to the starter motor, the capacitor powering the starter motor to initiate rotation of the crankshaft. An alternator is operatively connected to the engine and electrically connected to the capacitor for charging the capacitor when the engine is operating.

In another aspect, the marine outboard engine comprises a tiller operatively connected to the cowling; the capacitor being disposed on the tiller. Preferably the capacitor includes a plurality of capacitors arranged as a capacitor module and the tiller further includes a receptacle cavity configured to receive the capacitor module.

In a further aspect, the capacitor is disposed inside the cowling.

In an additional aspect, the marine outboard engine includes a pull-start system having a flywheel operatively connected to the crankshaft, a rope having a first end and a second end operatively connected to the flywheel; and a handle attached to the first end of the rope; the pull start system initiating rotation of the crankshaft upon operating the flywheel by pulling with the rope.

Another aspect of the invention is to provide a starting system for a marine outboard engine comprising: a tiller having a first end a second end; a throttle control disposed at the first end of the tiller; the second end of the tiller being adapted for connecting the tiller to the marine outboard engine. The starting system includes a capacitor mounted on the tiller, a starter motor connected to the capacitor; and an electrical connection electrically connecting the capacitor and the starter motor.

In an additional aspect, the starting system includes a starter switch having an on position and an off position, the switch being connected between the capacitor and the starter motor, wherein the capacitor and the starter motor are electrically connected when the starter switch is at the on position.

In a further aspect, the capacitor includes a plurality of capacitors arranged as a capacitor module. Preferably, the tiller includes a cavity configured to receive the capacitor module and the capacitor module includes a sealed protective box configured to be mounted in the cavity. In yet another aspect, the capacitor module is removably connected to the tiller.

An additional aspect of the invention is to provide a method for operating a starting system of a marine outboard engine, the outboard engine including an engine having a crankshaft, a starter motor operatively connected to the crankshaft, a capacitor electrically connected to the starter motor, an alternator operatively connected to the engine and electrically connected to the capacitor, and a switch having an operating position. the method comprising: actuating the switch to the on position; discharging the capacitor to the starter motor to initiate rotation of the starter motor; and recharging the capacitor with power generated by the alternator once the engine is operating under its own power.

In another aspect, the outboard engine includes an electronic control unit (ECU) electronically connected to the engine and a battery charging module (BCM) electronically connected to the capacitor and to the alternator, the method further comprising the step of recharging the capacitor at a constant voltage.

Advantages of using capacitors or ultra-capacitors for feeding electrical current to the starter motor for cranking the engine of the marine outboard engine as opposed to a battery are numerous. First, the capacitors or ultra-capacitors may be integrated into the marine outboard engine as a module 100 without increasing the size of the outboard engine; and its integration eliminates the need for external electrical connection as with a battery based electric starting system. Second, capacitors or ultra capacitors are much lighter than a battery and may be integrated into small portable marine outboard engines without significantly increasing the weight and size of the portable marine outboard engine. Third, capacitors or ultra capacitors have a longer life than a battery. Ultra capacitors can perform over 500,000 charge discharge cycles. Fourth, ultra capacitors have more current available at low temperatures than a battery. Fifth, ultra capacitors are less susceptible to vibrations than batteries.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention as well as other aspects and further features thereof, reference is made to the following description which is to be used in conjunction with the accompanying drawings, where.

DESCRIPTION OF PREFERRED EMBODIMENT(S)

Figure 1:
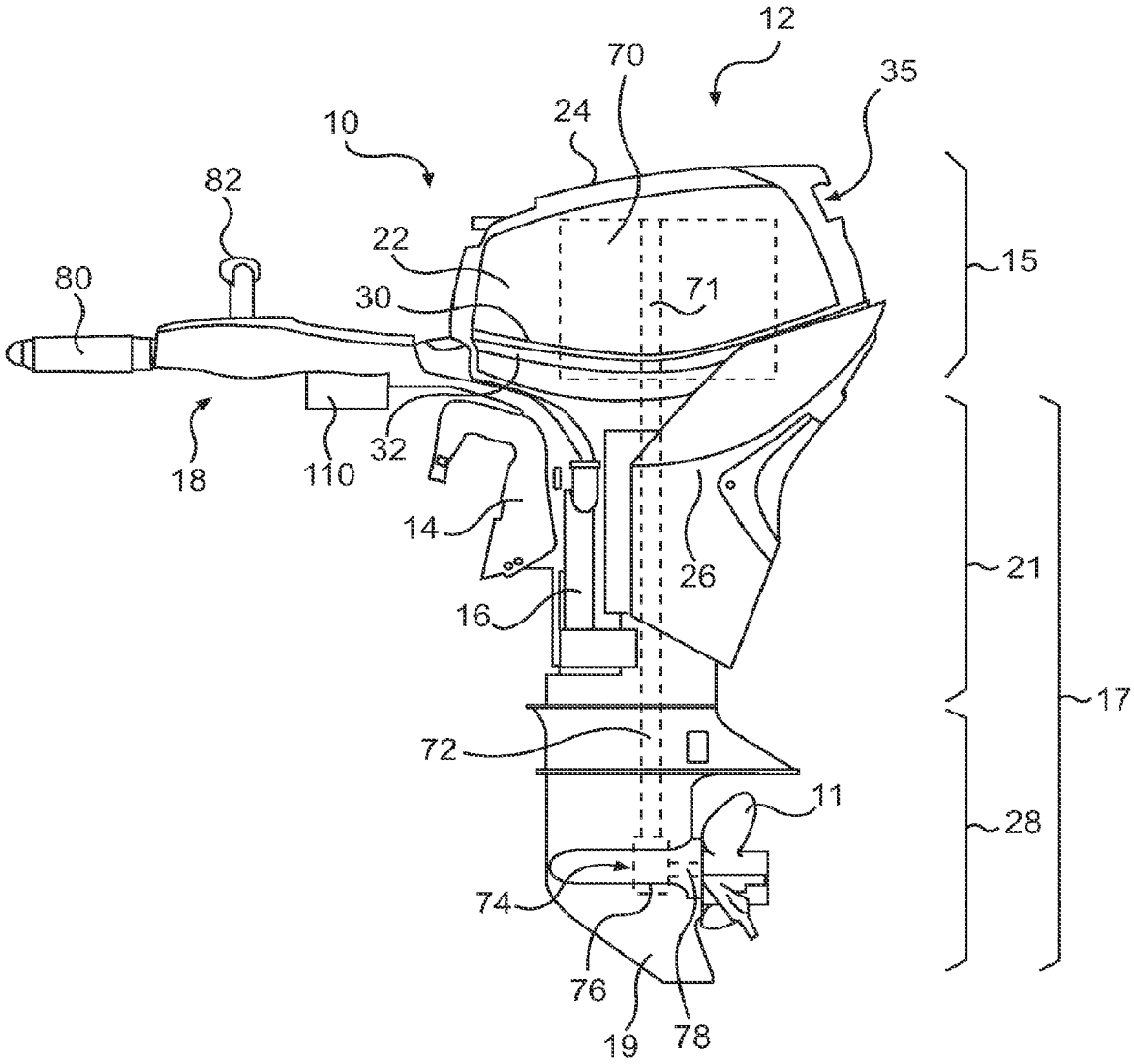
FIG. 1 is a side elevational view of a marine outboard engine in accordance with one embodiment of the invention.

Referring to the figures, FIG. 1 is a side view of a marine outboard engine 10 shown in an upright position, having a cowling 12. The outboard engine 10 includes a top portion 15 and a bottom portion 17. The bottom portion 17 includes a mid-section 21, a gear case assembly 28, and a skeg portion 19 as well as a bladed rotor of the marine outboard engine 10.

The cowling 12 surrounds and protects an engine 70 housed within the cowling 12. The engine 70 is shown in dotted lines in FIG. 1. The engine 70 is a conventional two-stroke internal combustion engine, such as an in-line two-stroke, two-cylinder engine which is vertically oriented when the marine outboard engine 10 is standing upright. The engine 70 includes a crankcase and a crankshaft 71 disposed in the crankcase. It is contemplated that other types of engine could be used, such as a four-stroke engine.

The crankshaft 71 of engine 70 is operatively connected to a vertically oriented driveshaft 72 disposed in the cowling 12 generally parallel to the crankcase 71. The driveshaft 72 is coupled to a drive mechanism 74, which includes a transmission 76 and a bladed rotor, such as the propeller 11 mounted on a propeller shaft 78 which is operatively connected to the transmission 76. The propeller shaft 78 is disposed at least in part in the gear case assembly 28 generally perpendicular to the driveshaft 72. The driveshaft 72 as well as the drive mechanism 74 are housed within the gear case assembly 28 of the bottom portion 17, and transfer the power of the engine 70 to the propeller 11 mounted on the rear side of the gear case assembly 28 of the outboard engine 10. The propulsion system of the outboard engine 10 could also include a jet propulsion device, turbine or other known propelling device. The bladed rotor could also be an impeller.

A stern bracket 14 is connected to the engine 10 via the swivel bracket 16 for mounting the outboard engine 10 to a watercraft. The stem bracket 14 can take various forms, the details of which are conventionally known. The swivel bracket 16 is pivotally connected to the stem bracket 14 such that the angle of outboard engine 10 relative to the watercraft may be changed in order to steer the watercraft.

In the specific embodiment shown in FIG. 1, a tiller 18 is operatively connected to the cowling 12 and extends from the cowling 12 to provide a leverage to allow manual steering of the outboard engine 10. The tiller 18 is rotatably fastened to the cowling 12 such that it can be raised for ease of handling and transportation. The tiller 18 includes a handle 80 which is also a the throttle control as in most conventional small marine outboard engine with a twist grip, and a shift lever 82 for selecting the forward, neutral or reverse gear.

It is contemplated that other steering mechanisms could be provided to allow steering, such as the steering wheel of a boat.

The cowling 12 includes an upper motor cover assembly 22 with a top cap 24, and a lower motor cover 26. The lowermost portion, commonly called the gear case assembly 28 and including the skeg portion 19, is attached to the lower motor cover 26. The upper motor cover 12 preferably encloses the top portion of the engine 70. The lower motor cover 26 surrounds the remainder of the engine 70 and the exhaust system. The mid-section 21 of the outboard engine 10 is the vertical portion of the outboard engine 10 extending from the lower motor cover 26 to the gear case assembly 28 and includes the lower half of the lower motor cover 26. The gear case assembly 28 encloses the transmission 76 and supports the drive mechanism 74 in a known manner. The propeller 11 is disposed behind the gear case assembly 28.

The upper motor cover 22 and the lower motor cover 26 are made of sheet material, preferably plastic, but could also be metal, composite or the like. The lower motor cover 26 and/or other components of the cowling 12 can be formed as a single piece or as several pieces. For example, the lower motor cover 26 can be formed as two lateral pieces mating along a vertical joint. The lower motor cover 26, which is also made of sheet material, is preferably made of plastic, but could also be metal, composites or the likes. One suitable composite is a sheet molding compound (SMC) which is typically a fibreglass reinforced sheet molded to shape.

A lower edge 30 of the upper motor cover 22 mates in a sealing relationship with an upper edge 32 of the lower motor cover 26. A seal is disposed between the lower edge 30 of the upper motor cover 22 and the upper edge 32 of the lower motor cover 26 to form a watertight connection.

A locking mechanism is provided on at least one of the sides or at the front or back of the cowling 12 to lock the upper motor cover 22 onto the lower motor cover 26. Preferably, two locking mechanisms are provided on two opposite sides of the cowling 12.

The upper motor cover 22 is formed with two parts, but could also be a single cover. The upper motor cover 22 includes an air intake portion 35 formed as a recessed portion on the rear of the cowling 12. The air intake portion 35 is configured to prevent water from entering the interior of the cowling 12 and reaching the engine 70 housed therein. Such a configuration can include a tortuous path. The top cap 24 fits over the upper motor cover 22 in a sealing relationship and preferably defines a portion of the air intake portion 35. Alternatively, the air intake portion 35 can be wholly formed in the upper motor cover 22 without the use of a top cap 24 or in the lower motor cover 26.

Figure 2:
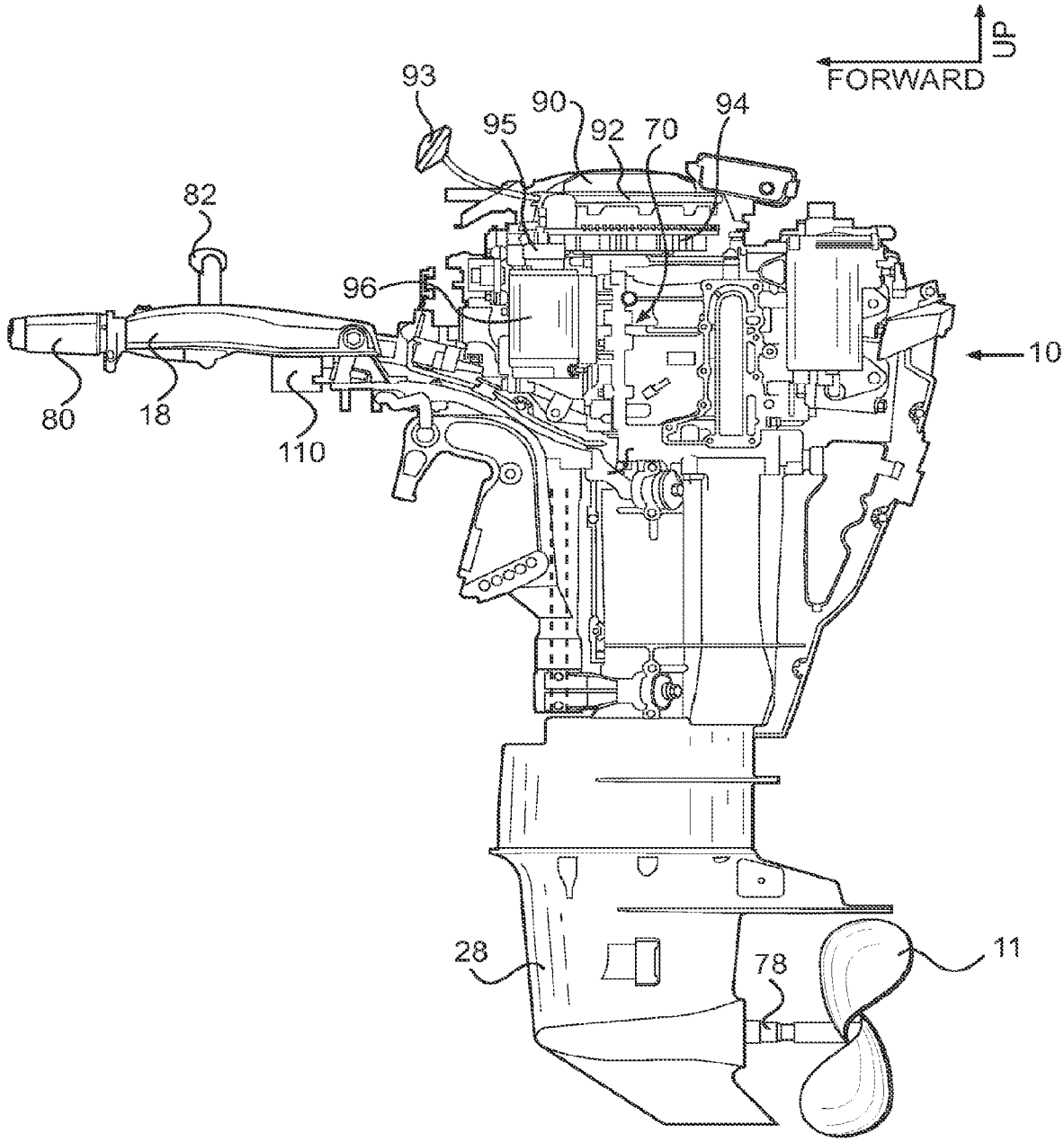
FIG. 2 is a side elevational view of the marine outboard engine shown in FIG. 1 with its cowling removed.

Referring now to FIG. 2, details of the engine 70 will now be described. A flywheel/alternator 90 is located on top of the engine 70. The flywheel/alternator 90 is connected directly to the crankshaft (not shown) of the engine 70. The flywheel/alternator 90 also acts as a pull-start system and includes a pulling rope 92 connected to the flywheel/alternator 90 at one end which is wound around the flywheel/alternator 90 and a handle 93 provided at the other end of the rope 92 to enable the user to pull on the rope 92 to crank and start the engine 70 manually. The flywheel portion 94 of the flywheel/alternator 90 has a toothed outside circumference such that it acts like a large gear and can be engaged by the pinion gear 95 of the starter motor 96 located directly below the flywheel portion 94 of the flywheel/alternator 90. In operation, when solenoid (not shown) of the starter motor 96 is activated by an electric current I, the pinion gear 95 extends to engage the flywheel portion 94 of the flywheel/alternator 90 and rotates the flywheel/alternator 90 to crank and start the engine 70. The electric starting system of the marine outboard engine 10 presently described has the particularity that no battery is required. The electric current is provided by a series of large cell capacitors that effectively replace the battery and provide the necessary power to the starter motor 96 to crank the engine 70.

Figure 3:
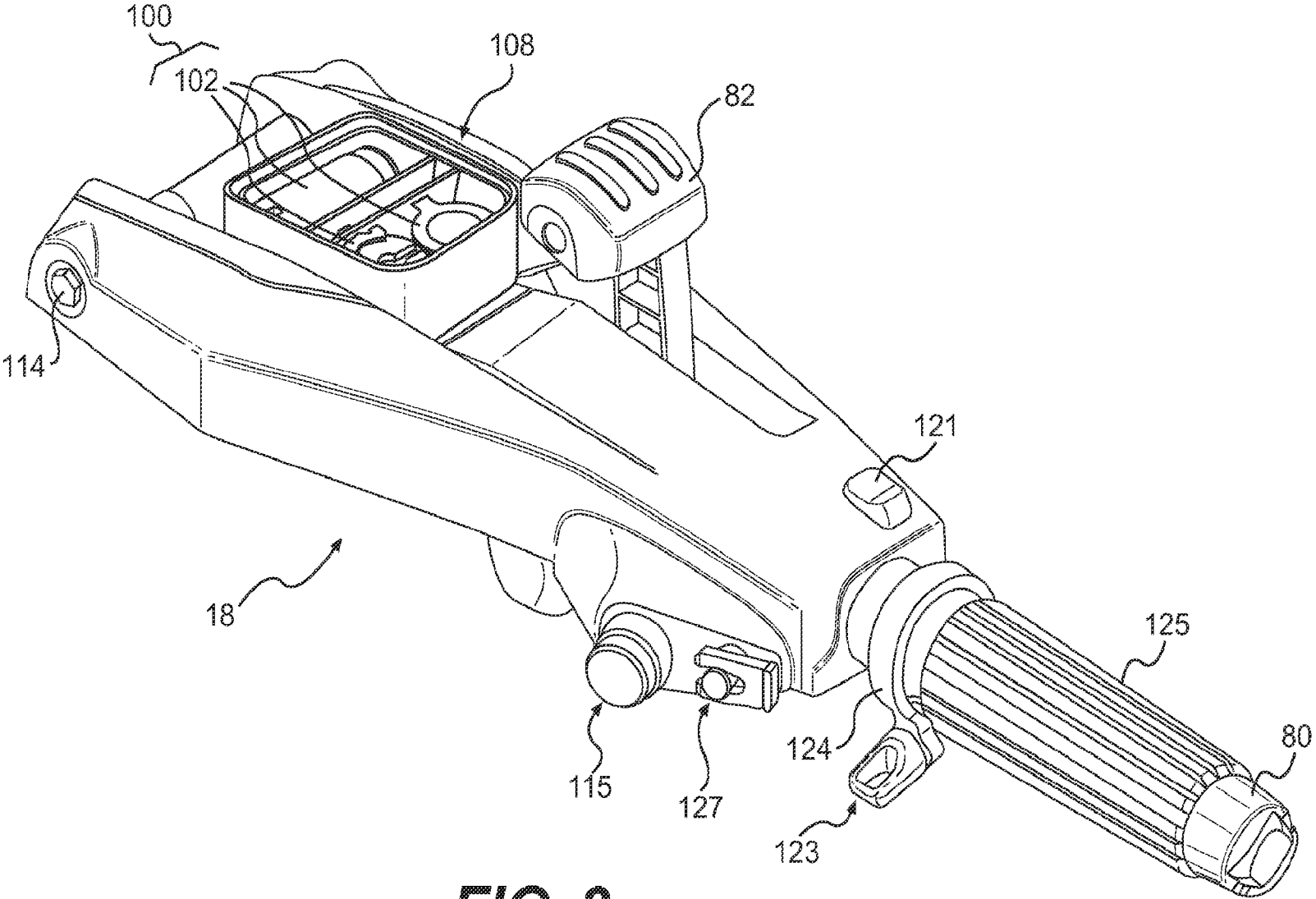
FIG. 3 is a perspective view, taken from the front, left side, of the tiller of the marine outboard engine shown in FIG. 1.

With reference to FIG. 3, which illustrates the tiller 18 in isolation, an ultra-capacitor module 100 is positioned within a protective box 110 (FIG. 4) with its top portion removed to show that the ultra capacitor module 100 consists of a series of ultra capacitors 102. The protective box 110 is installed within a cavity 108 of the tiller 18 configured to receive the protective box 110 and the ultra capacitor module 100 disposed therein. One example of ultra capacitors that can be used to form the ultra-capacitor module 100 is the BC Energy Series BOOSTCAP® Ultracapacitors produced by Maxwell™ Technologies with a rated voltage of 2.5 Volts. In the illustrated embodiment, the ultra-capacitor module 100 includes six ultra capacitors 102 connected in series for a total rated voltage of 15 Volts. The ultra-capacitor module 100 preferably includes a balancing circuit, also produced by Maxwell™, to control the discharge of ultra-capacitors 102 so each discharge at an equal rate.

Figure 3A:
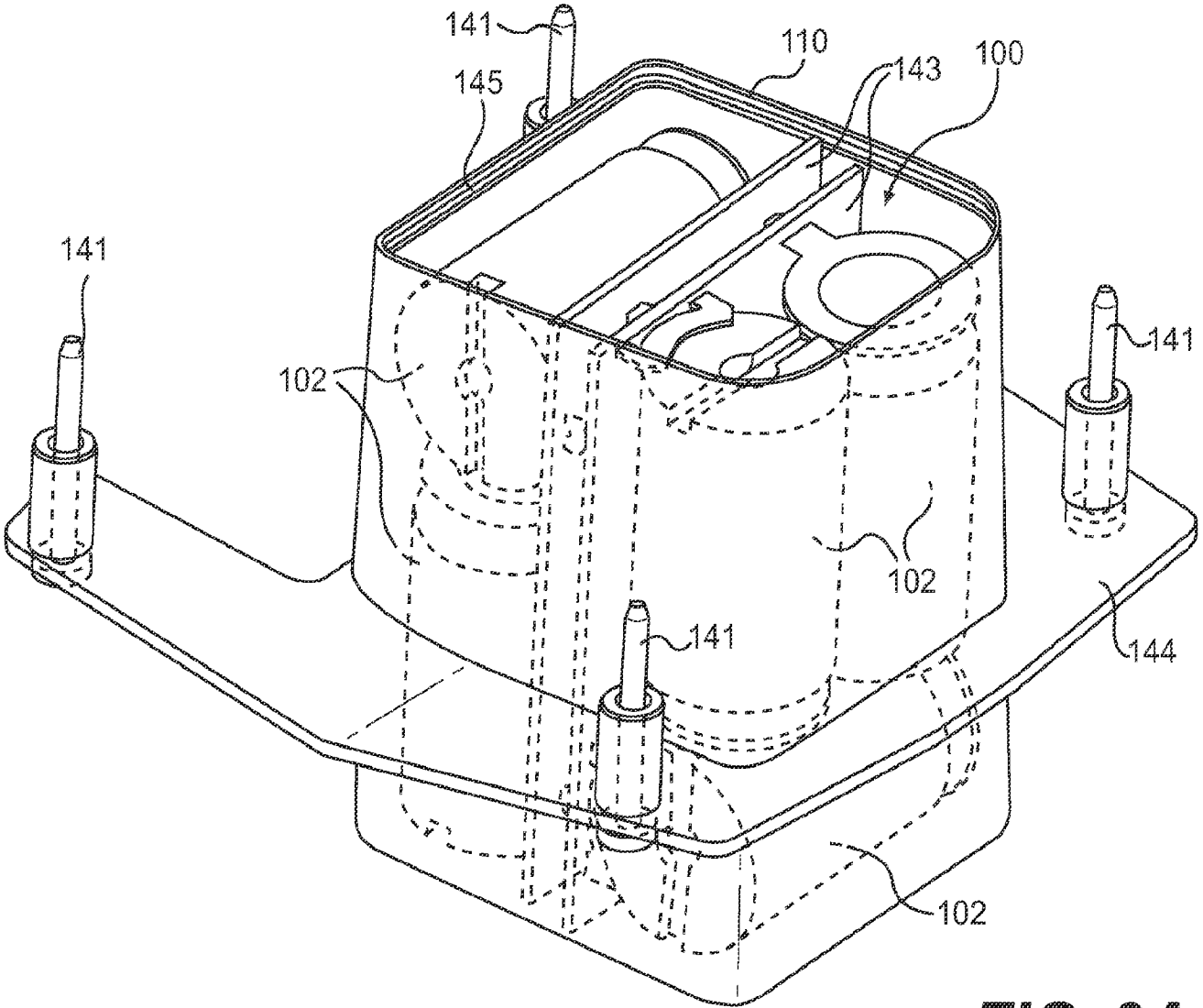
FIG. 3A is a perspective view of an ultra-capacitor module positioned inside a protective box.

With reference to FIG. 3A, the ultra-capacitor module 100 includes six ultra capacitors 102 connected in series via a pair of electrically conductive mounting plates 143. Three ultra capacitors 102 are disposed on one mounting plate 143 and the other three ultra capacitors 102 are disposed on the other mounting plate 143 to form the ultra capacitor module 100. The ultra capacitor module 100 is positioned within the protective box 110 (shown in contour lines) which is sealed to protect the capacitors 102 inside. In one specific embodiment, an isolating filler is poured into the protective box 110 to fill the spaces between the capacitors 102 and protect them against water and vibration. The protective box 110 is a plastic molded part which includes a rim 144 extending laterally from the main body 145 of the protective box 110. The main body 145 of the protective box 110 is designed to fit within the cavity 108 of the tiller 18 while the rim 144 is adapted to mate with the contour of the cavity 108 as shown in FIG. 4A. The rim 144 includes fastening elements 141 for securing the protective box 110 to the tiller 18. Fastening elements 141 may be screws or rivets or any other know fastening devices.

Referring back to FIG. 3, the control elements of the marine outboard engine 10 are located on the tiller 18 where they are readily accessible to the boater. The handle 80 includes a throttle control 125 which allows opening and closing of the throttle by a clockwise or counterclockwise rotational movement around the handle 80. A throttle friction ring 124 can be adjusted by tightening or loosening the adjustment screw 123 such that the throttle control 125 can be locked in a position or the pressure required to turn the throttle control 125 adjusted to suit the needs or preferences of the boater. An electronic engine idle speed adjuster 121 is provided near the throttle control 125 that can be used to adjust the RPM of the engine 70 when throttle control 125 is at the idle position i.e. turned to the minimum throttle opening position. A start button 115 linked to a starting switch 116 (FIG. 6) is positioned on one side of the tiller 18 for starting the engine 70 and a stop button 127 is provided next to the start button 115 to stop the engine 70. The rear end of the tiller 18 is provided with a fastener 114 such as a long bolt adapted for rotatably connecting the tiller 18 to the marine outboard engine 10.

Figure 4:
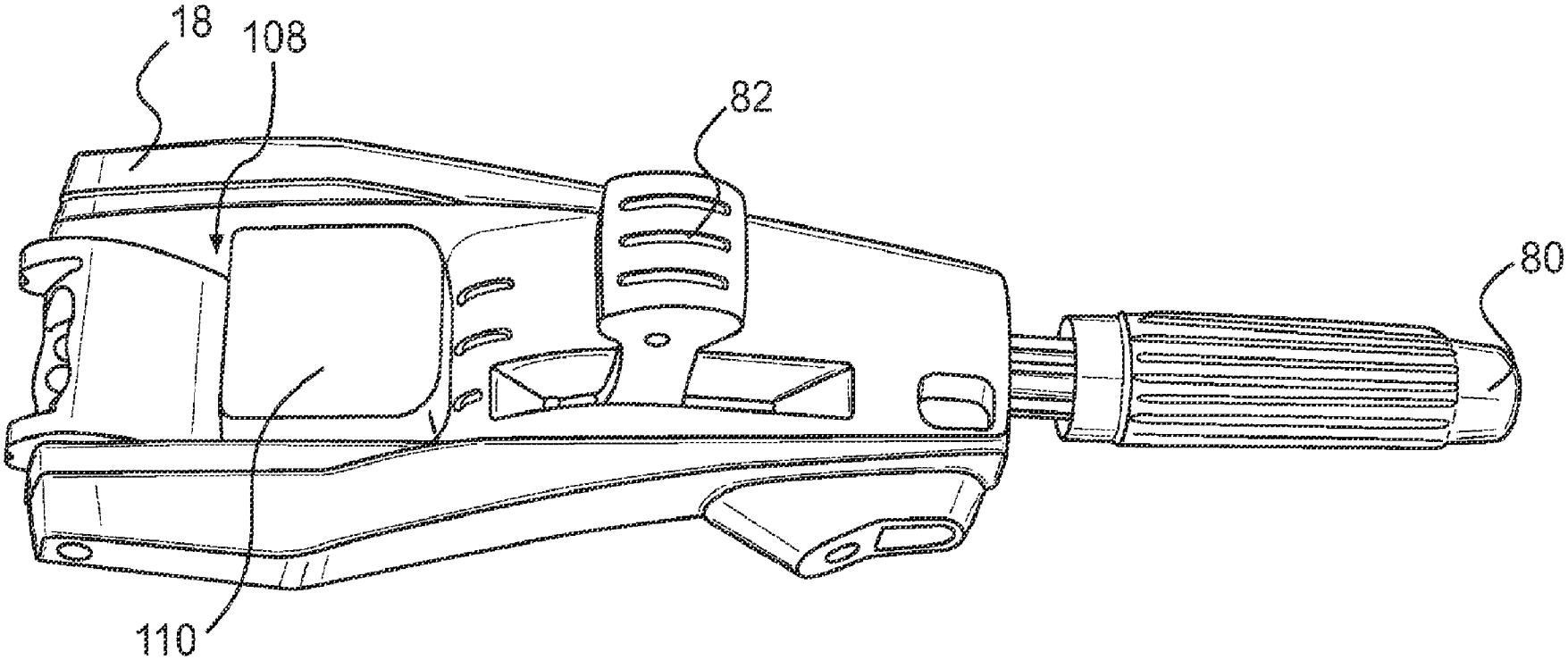
FIG. 4 is a perspective view, taken from the left side, of the tiller shown in FIG. 3.
Figure 4A:
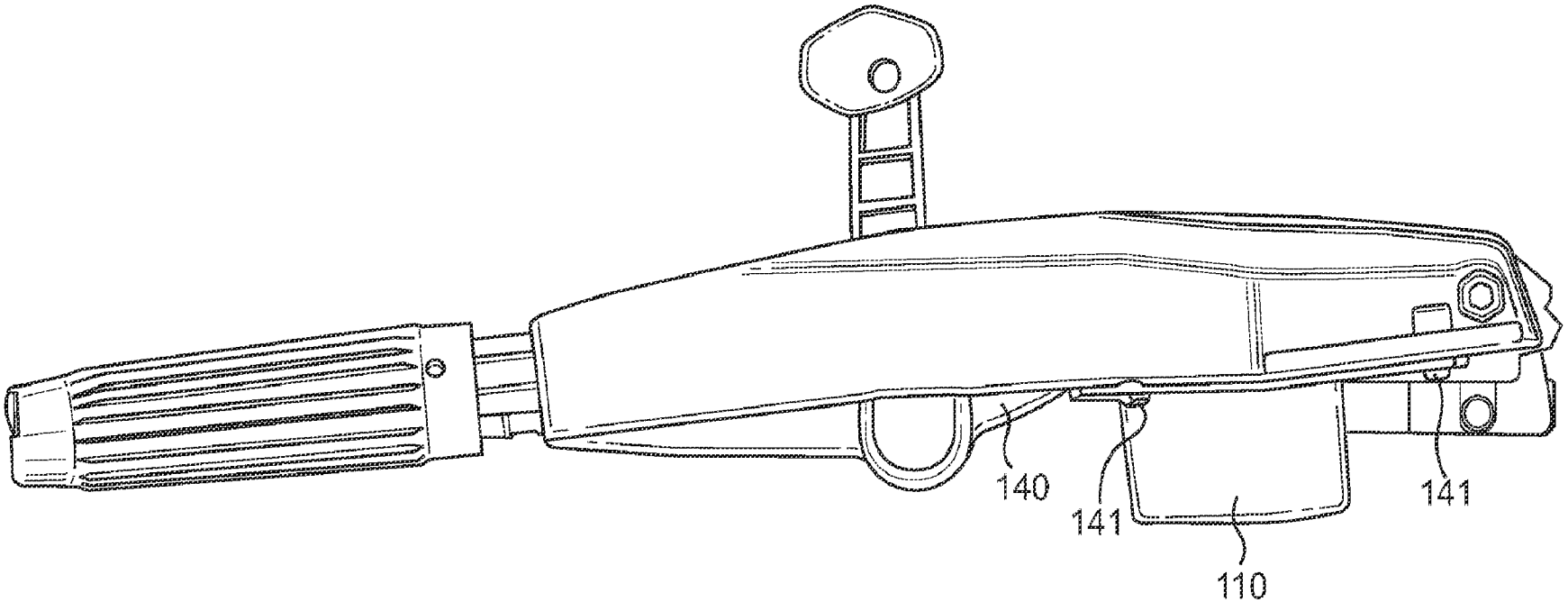
FIG. 4A is a side elevational view of the tiller shown in FIG. 3.

With reference to FIG. 4, The sealed protective box 110 with the ultra capacitor module 100 inside is positioned in the receptacle cavity 108 of the tiller 18. As shown in FIG. 4A, the sealed protective box 110 is inserted in the cavity 108 from under the tiller 18 and secured to the lower portion 140 of the tiller 18 using the fastening elements 141.

The ultra capacitor module 100 is preferably positioned on the tiller 18 inside the sealed protective box 110 because capacitors perform best in a dry space and tend to degrade at high temperatures. Positioning the ultra capacitor module 100 outside of the engine cowling 12 at least partially isolates the capacitors from the engine heat thereby preventing undue degradation of the capacitors. The tiller 18 is sufficiently removed from the engine heat to preserve the quality of the capacitors of the ultra capacitor module 100. Furthermore, the ultra capacitor module 100 may be supplied as an add-on or optional accessory for the marine outboard engine to replace a battery. Therefore, positioning the ultra capacitor module 100 on the tiller 18 requires a much simpler installation than somewhere else on the marine outboard engine 10.

Figure 5:
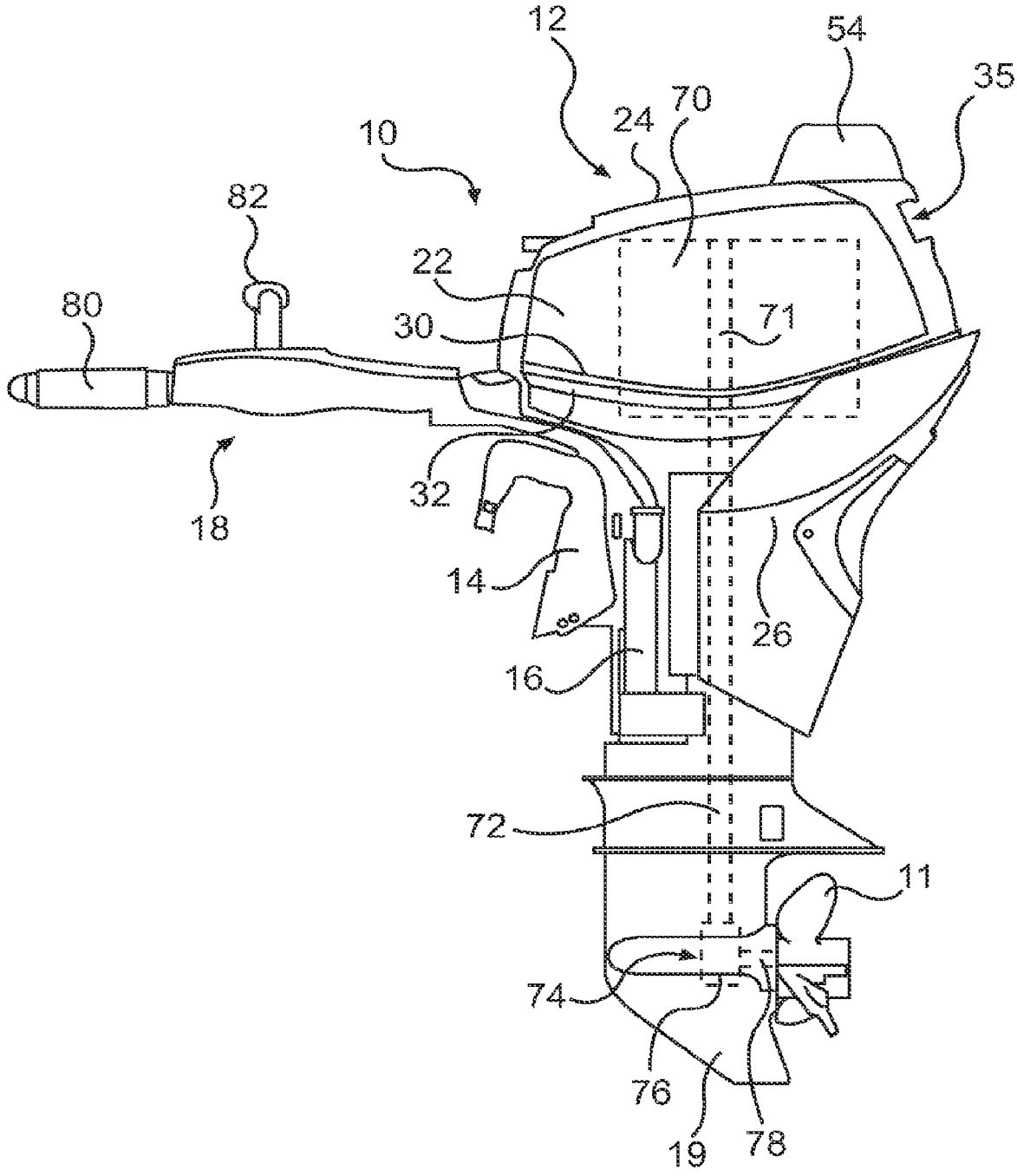
FIG. 5 is a side elevational view of a marine outboard engine in accordance with a second embodiment of the invention.

However, in an alternate embodiment illustrated in FIG. 5, the ultra capacitor module 100 may be positioned inside a chamber 54 positioned above the cowling 12 that provides a dry space for the ultra capacitor module 100 which is also protected from excessive heat by the cowling. The chamber 54 could be positioned anywhere on or inside the cowling 12 where there is sufficient space.

Figure 6:
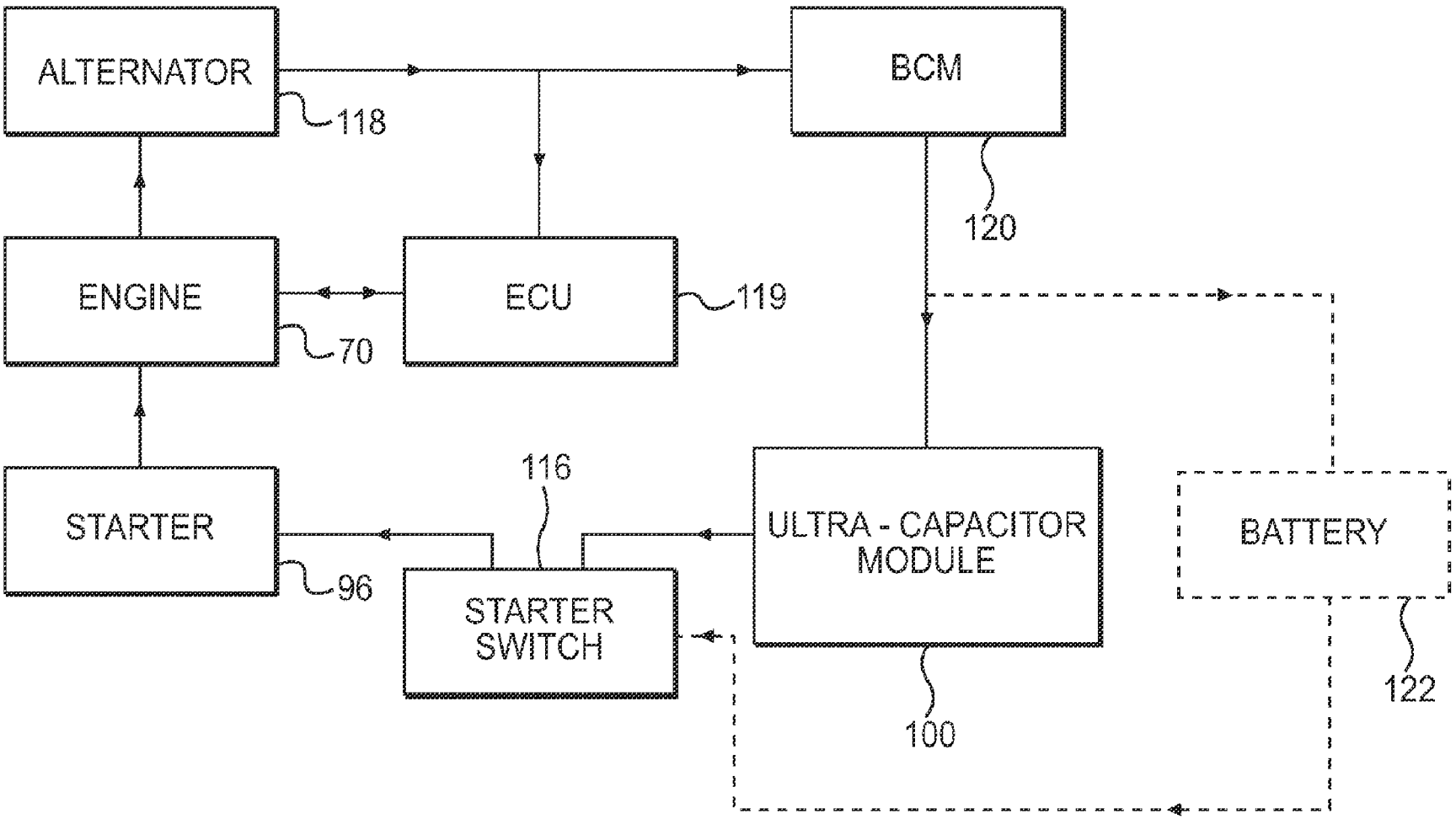
FIG. 6 is a schematic electrical diagram of the starting and charging system of the marine outboard engine shown in FIG. 1.

Referring now to FIG. 6, the starting system includes a starting switch 116 which is controlled by the starting button 115 (FIG. 3). The starting switch 116 connects the ultra-capacitor module 100 to the solenoid of the starter motor 96. The starter motor 96 is operatively connected to the flywheel/alternator 90 of the engine 70 as previously described with reference to FIG. 2. The alternator 118 of the flywheel/alternator 90 is connected to the engine's Electronic Control Unit (ECU) 119 which directs electrical current produced by the alternator 118 to the engine 70. The ECU 119 also receives signals from various the sensors (not shown) of the engine 70. The alternator 118 is also connected to a Battery Charging Module (BCM) 120 which is itself connected to the ultra capacitor module 100 to monitor and control the charge of the ultra-capacitor module 100. The starting system may include a battery 122 as illustrated in dotted lines in the diagram of FIG. 6 in combination with the ultra-capacitor module 100.

Figure 7:
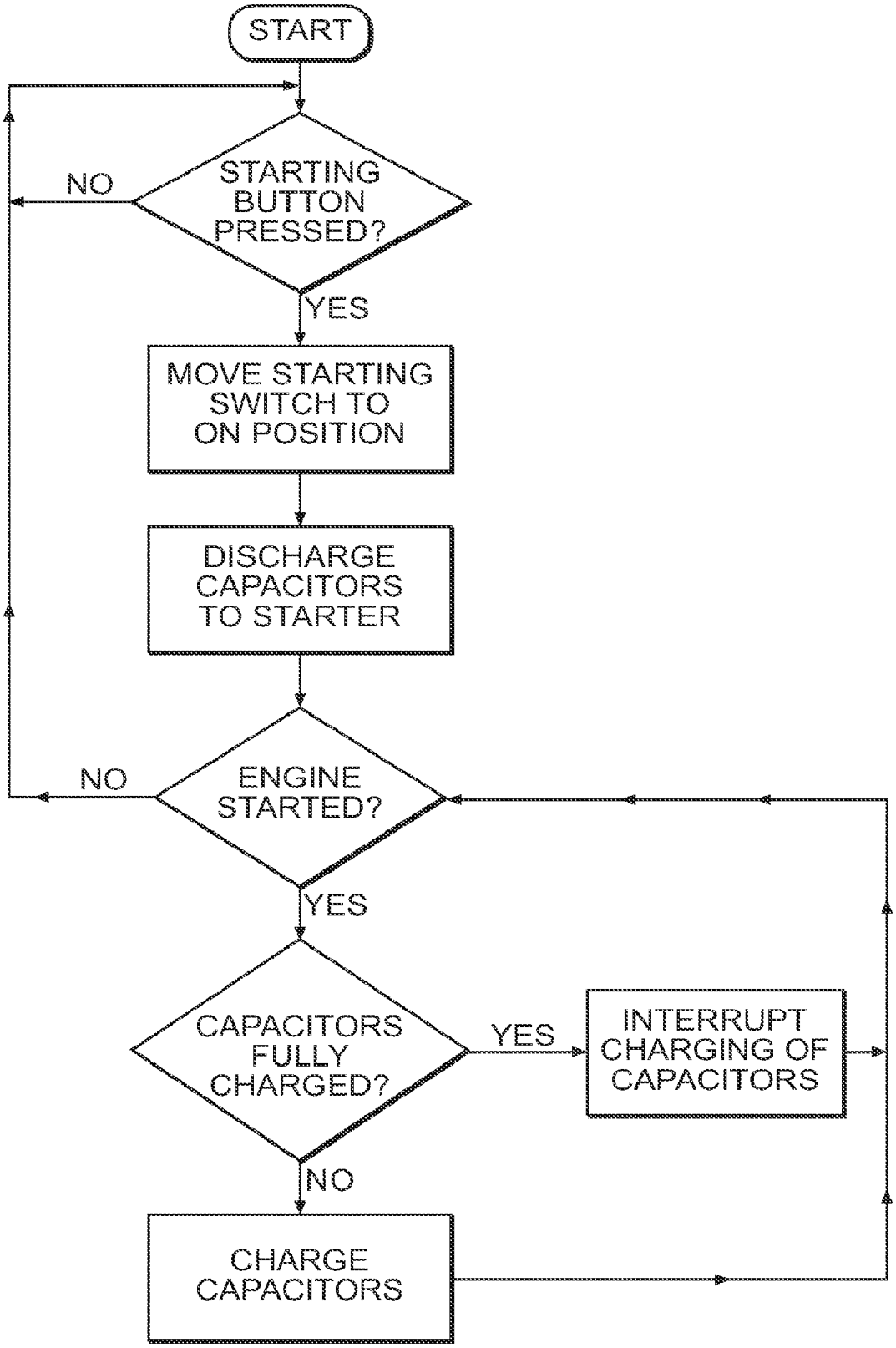
FIG. 7 is a flowchart of the operation of the marine outboard engine shown in FIG. 1.

With reference to FIG. 7, when the starting button 115 is pressed, the starting switch 116 is closed or in the ON position, and electrical current is delivered to the solenoid of the starter motor 96 which cranks the engine 70. When the engine 70 has started, and is operating under its own power, the alternator 118 provides electrical current the engine's Electronic Control Unit (ECU) 119 which directs electrical current to the engine 70 to maintain the engine running and to the Battery Charging Module (BCM) 120 which diverts a portion of the electrical current produced by the alternator at a constant voltage of 12 Volts to the ultra capacitor module 100 to recharge the ultra capacitor module 100. The ultra capacitor module 100 is recharged to full power in approximately thirty (30) seconds of the engine 70 operating at idle speed so that the charge of the ultra capacitor module 100 is restored rapidly. When the ultra capacitor module 100 reaches 12 Volts, the ultra capacitor module 100 is fully recharged since the BCM 120 recharge current is at a constant voltage of 12 Volts.

The same Battery Charging Module (BCM) 120 can be used whether a battery or an ultra-capacitor is used to start the engine 70. The BCM 120 is powered by the alternator.

The ultra capacitor module 100 is able to provide approximately 3 seconds of cranking which is enough for two or three engine start attempts. In the event that the engine 70 fails to start during the cranking time available from the ultra capacitor module 100, the boater may resort back to the pull-start system by pulling on the pulling rope 92 (FIG. 2) which serves as a back-up for the electrical start system.

A battery is not required in the electrical system because the ultra capacitor module 100 is able to supply sufficient power to drive the starter in cranking the engine 70 and is recharged exclusively by the alternator which also generates sufficient electrical current to supply to power the engine 70.

Modifications and improvement to the above described embodiments of the present invention may become apparent to those skilled in the art. The foregoing description is intended to be exemplary rather than limiting. Furthermore, the dimensions of features of various components that may appear on the drawings are not meant to be limiting, and the size of the components therein can vary from the size that may be portrayed in the figures herein. The scope of the present invention is therefore intended to be limited solely by the scope of the appended claims.

What is claimed is:

1. A marine outboard engine comprising:

a cowling;

an engine disposed in the cowling, the engine including:

a crankcase;

at least one cylinder connected to the crankcase; and a crankshaft disposed in the crankcase;

a driveshaft disposed in the cowling generally parallel to the crankshaft, the driveshaft having a first end and a second end, the first end of the driveshaft being operatively connected to the crankshaft;

a gear case operatively connected to the cowling;

a transmission disposed in the gear case, the transmission being operatively connected to the second end of the driveshaft;

a propeller shaft disposed at least in part in the gear case generally perpendicular to the driveshaft, the propeller shaft being operatively connected to the transmission;

a bladed rotor connected to the propeller shaft;

a starter motor operatively connected to the crankshaft of the engine;

a tiller operatively connected to the cowling;

a capacitor disposed on the tiller, the capacitor being electrically connected to the starter motor, the capacitor powering the starter motor to initiate rotation of the crankshaft; and an alternator operatively connected to the engine and electrically connected to the capacitor for charging the capacitor when the engine is operating.

2. The marine outboard engine of claim 1, wherein the capacitor is a plurality of capacitors arranged as a capacitor module.

3. The marine outboard engine of claim 2, wherein the tiller further includes a cavity configured to receive the capacitor module.

4. The marine outboard engine of claim 1, further comprising a pull-start system including:

a flywheel operatively connected to the crankshaft;

a rope having a first end and a second end operatively connected to the flywheel; and a handle attached to the first end of the rope;

the pull start system initiating rotation of the crankshaft upon operating the flywheel by pulling the rope with the handle.

5. The marine outboard engine of claim 1, further comprising an electronic control unit (ECU) electrically connected to the alternator.

6. The marine outboard engine of claim 1, further comprising a battery charger module (BCM), the capacitor being electrically connected to the alternator via the BCM.

7. A starting system for a marine outboard engine comprising:

a tiller having a first end a second end;

a throttle control disposed at the first end of the tiller;

the second end of the tiller being adapted for connecting the tiller to the marine outboard engine;

a capacitor mounted on the tiller;

a starter motor connected to the capacitor; and an electrical connection electrically connecting the capacitor and the starter motor.

8. The starting system of claim 7, wherein the capacitor is a plurality of capacitors arranged as a capacitor module.

9. The starting system of claim 8, wherein the tiller includes a cavity configured to receive the capacitor module.

10. The starting system of claim 9, further comprising a sealed protective box configured to be mounted in the cavity, wherein the plurality of capacitor are disposed in sealed protective box.

11. The starting system of claim 9, wherein the capacitor module is removably connected in the cavity of the tiller.

12. The starting system of claim 7, further comprising a starter switch disposed on the tiller and having an on position and an off position, the starter switch being connected between the capacitor and the starter motor; and wherein the capacitor and the starter motor are electrically connected when the starter switch is at the on position.

* * * * *